US007854152B2

(12) United States Patent
Oh et al.

(10) Patent No.: US 7,854,152 B2
(45) Date of Patent: Dec. 21, 2010

(54) STEAM GENERATOR FOR WASHING MACHINE

(75) Inventors: Soo Young Oh, Seoul (KR); Kyung Chul Woo, Seoul (KR); Jin Woong Kim, Gyeonggi-Do (KR); Si Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 679 days.

(21) Appl. No.: 10/757,416

(22) Filed: Jan. 15, 2004

(65) Prior Publication Data

US 2005/0034489 A1 Feb. 17, 2005

(30) Foreign Application Priority Data

Aug. 13, 2003 (JP) ..... 10-2003-0056226

(51) Int. Cl.
*D06F 39/04* (2006.01)

(52) U.S. Cl. ..... 68/12.22; 68/12.01; 68/12.02; 68/12.14; 68/12.18; 68/12.19

(58) Field of Classification Search ..... 68/5 R, 68/12.01, 12.02, 12.12, 12.14, 12.18, 12.19, 68/12.22

See application file for complete search history.

(56) References Cited

U.S. PATENT DOCUMENTS

| | | | | | |
|---|---|---|---|---|---|
| 3,972,966 | A | * | 8/1976 | Lund et al. | 261/114.1 |
| 4,239,956 | A | * | 12/1980 | Morton | 392/402 |
| 4,512,784 | A | * | 4/1985 | De Loach | 96/181 |
| 5,253,378 | A | * | 10/1993 | Jung, Jr. | |
| 5,561,880 | A | * | 10/1996 | Allen et al. | |
| 5,829,275 | A | * | 11/1998 | Babuin et al. | 68/12.13 |
| 5,878,602 | A | * | 3/1999 | Kovich et al. | 68/134 |
| 6,142,705 | A | * | 11/2000 | Edwards et al. | 405/127 |

FOREIGN PATENT DOCUMENTS

| | | | | |
|---|---|---|---|---|
| DE | 197 43 508 | A1 | | 4/1999 |
| FR | 0816550 | | * | 1/1998 |
| JP | 2-198595 | A | | 8/1990 |
| JP | 6042705 | A | | 2/1994 |
| JP | 10-235088 | A | | 9/1998 |
| JP | 2003-019382 | | * | 1/2003 |
| JP | 2003-019382 | A | | 1/2003 |
| JP | 2003-093775 | A | | 4/2003 |
| JP | 2003-311084 | | * | 11/2003 |
| KR | 10-1997-0070295 | A | | 11/1997 |
| KR | 10-2003-0055963 | A | | 7/2003 |

* cited by examiner

*Primary Examiner*—Michael Barr
*Assistant Examiner*—Jason Heckert
(74) *Attorney, Agent, or Firm*—Birch, Stewart, Kolasch & Birch, LLP

(57) ABSTRACT

A steam generator for a washing machine comprises: a hermetic container provided with a water supply port for supplying water and a steam exhaustion port for exhausting steam; a heater arranged in the hermetic container for heating water supplied into the hermetic container; and a drain unit for draining residual water inside of the hermetic container outwardly. According to this, residual water inside of the steam generator is outwardly exhausted thus to maintain cleanness of the steam generator. Also, the drain unit using a siphon principle is installed thus to naturally exhaust residual water inside of the steam generator without an additional valve device, thereby reducing a fabrication cost.

16 Claims, 4 Drawing Sheets

STEAM GENERATOR FOR WASHING MACHINE

This Nonprovisional application claims priority under 35 U.S.C. §119(a) on Patent Application No(s). 10-2003-0056226 filed in KOREA on Aug. 13, 2003, the entire contents of which are hereby incorporated by reference.

BACKGROUND OF THE INVENTION

1. Field of the Invention

The present invention relates to a steam generator for a washing machine, and more particularly, to a steam generator for a washing machine capable of heating laundry by directly spraying steam into the laundry.

2. Description of the Conventional Art

FIG. 1 is a sectional view of a washing machine in accordance with the conventional art.

The drum washing machine according to the conventional art comprises: a cabinet 102 for forming an appearance; a tub 104 arranged in the cabinet 102 for storing washing water; a drum 106 rotatably arranged in the tub 104 for washing and dehydrating laundry; and a driving motor 110 connected to the drum 106 by a driving shaft 108 for rotating the drum 106.

The tub 104 is shock-absorbingly supported in the cabinet 102 by dampers 120 and 122, and a heater 130 for heating washing water stored in the tub 104 is installed at a lower portion of the tub 104.

A lower portion of the tub 104 has to be provided with enough space for mounting the heater 130, and water level more than a certain amount has to be maintained in the tub 104 so that the heater 130 can be sufficiently soaked by washing water.

Operation of the conventional drum washing machine will be explained. First, once the washing machine is operated, washing water is supplied into the tub 104. Then, if water level of the tub 104 reaches a set level, the heater 130 is operated thus to heat the washing water. At the same time, a driving motor 110 is driven with a forward rotation or a reverse rotation thus to perform a washing operation. According to this, when temperature of the washing water reaches a set temperature, the heater 130 becomes off.

However, in the conventional washing machine, a space for accommodating the heater 130 has to be provided at the lower portion of the tub 104, so that an entire size of the washing machine becomes large. Besides, washing water has to be also provided to the space for accommodating the heater 130, waste of washing water becomes great.

Furthermore, washing water is heated by the heater 130 thus to increase a consumption power of the heater, to increase a detergent amount, and to lengthen washing time.

SUMMARY OF THE INVENTION

Therefore, an object of the present invention is to provide a steam generator for a washing machine capable of reducing an entire size of the washing machine, reducing an amount of washing water, minimizing a consumption power, and reducing washing time by heating laundry by directly spraying steam into the laundry.

Another object of the present invention is to provide a steam generator for a washing machine capable of reducing a cost by naturally performing a drain operation of the steam generator without an additional valve.

To achieve these and other advantages and in accordance with the purpose of the present invention, as embodied and broadly described herein, there is provided a steam generator for a washing machine comprising: a hermetic container provided with a water supply port for supplying water and a steam exhaustion port for exhausting steam; a heater arranged in the hermetic container for heating water supplied into the hermetic container; and a drain unit for draining residual water inside of the hermetic container outwardly.

The drain unit comprises: a siphon pipe arranged to be penetrated at a lower portion of the hermetic container; and a siphon cap arranged at an outer circumferential surface of the siphon pipe with a certain interval for forming a channel along which water rises.

The drain unit further comprises a supporting rib for supporting the siphon cap in order to maintain a certain interval between the siphon cap and the siphon pipe.

An upper end of the siphon pipe is positioned in the hermetic container, a lower end thereof is positioned outside the hermetic container, and a height of the siphon pipe positioned in the hermetic container is higher than a water supply level.

The siphon cap has a blocked upper side and covers the siphon pipe. Also, a lower end of the siphon cap is arranged to maintain a certain interval with a bottom surface of the hermetic container in order to introduce water.

The supporting rib is radially formed at the outer circumferential surface of the siphon pipe with a certain interval, and is provided with a mounting groove for mounting the lower end of the siphon cap.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
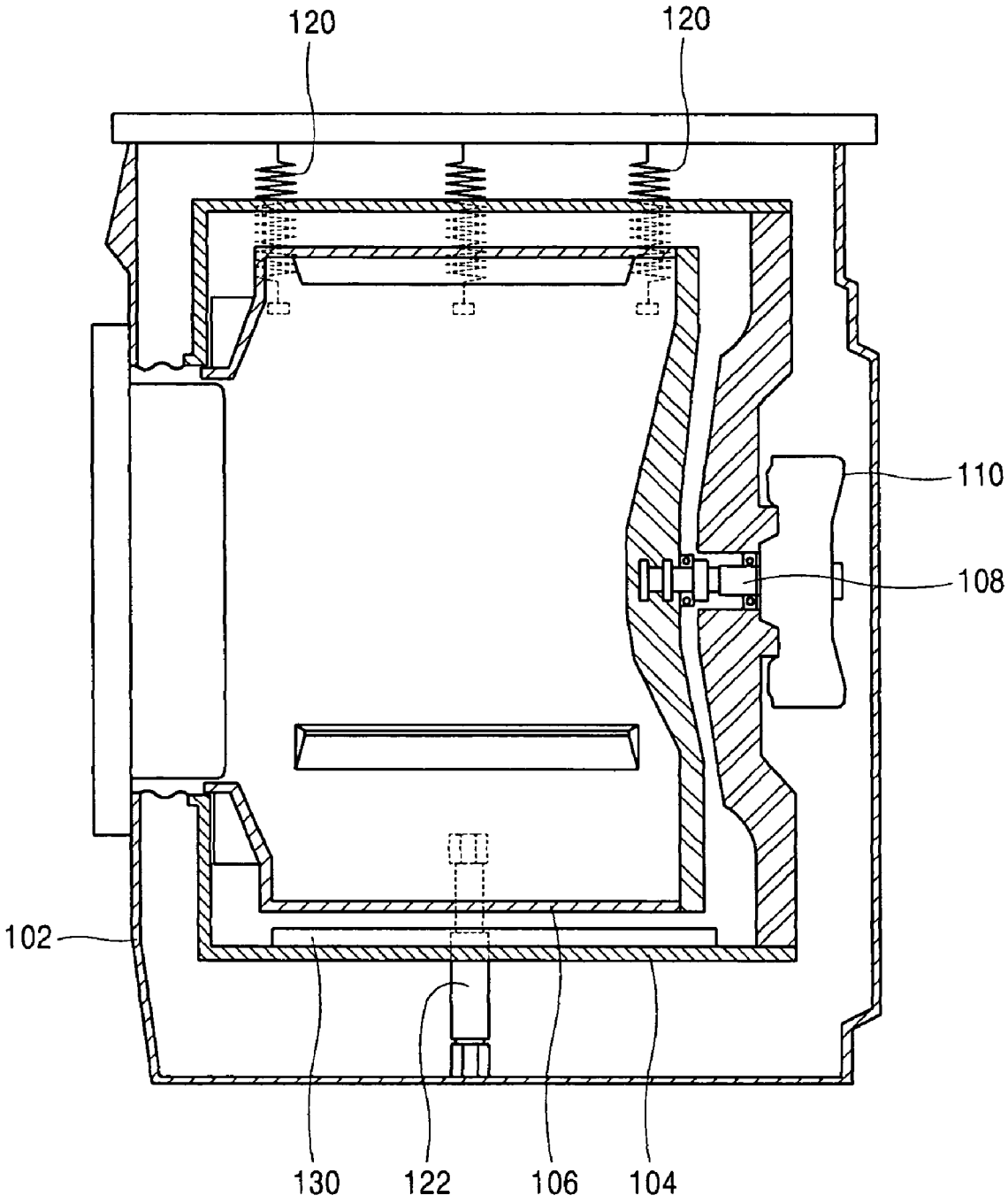
FIG. 1 CONVENTIONAL ART
FIG. 1 is a sectional view of a washing machine in accordance with the conventional art.
Figure 2:
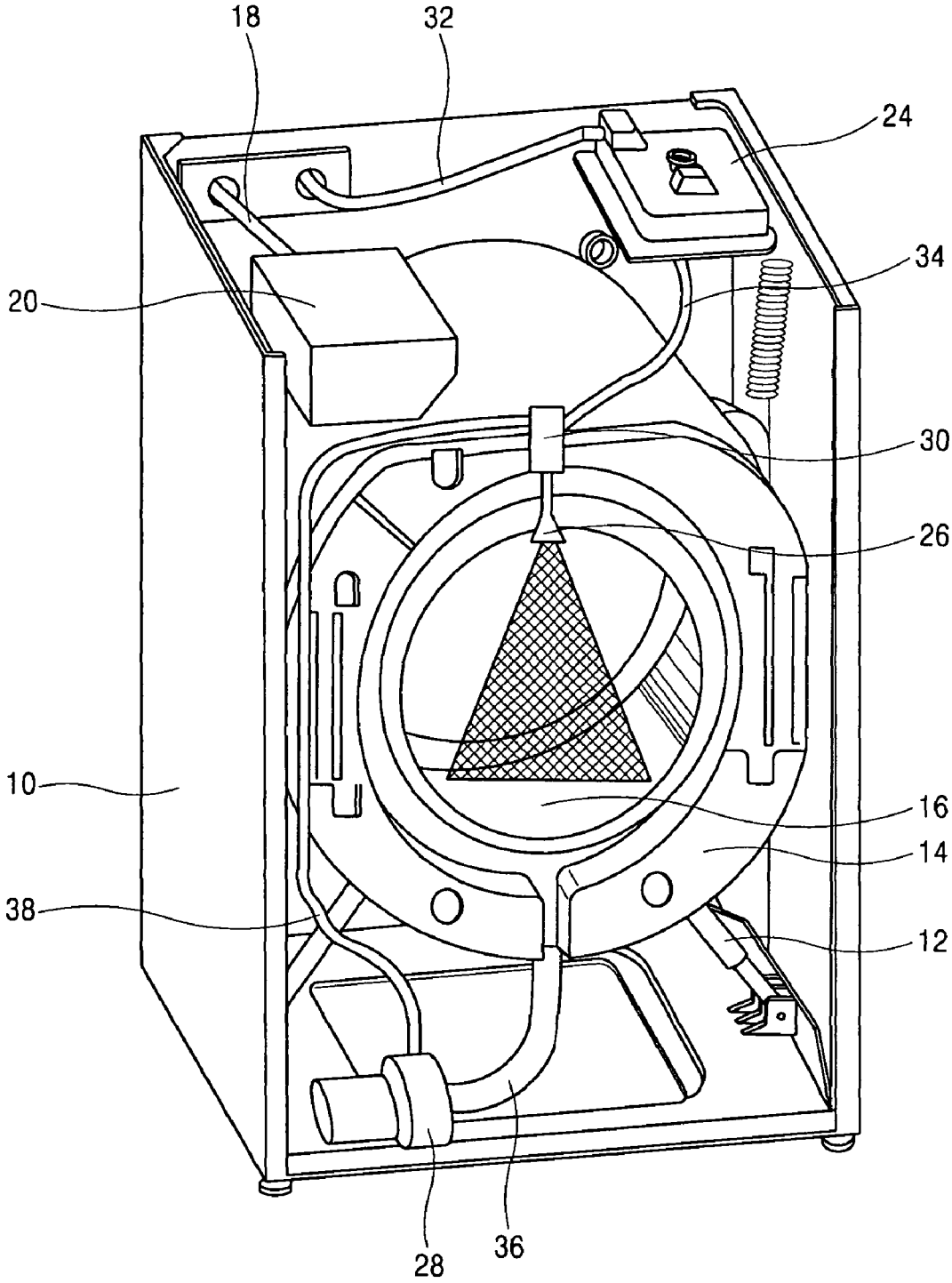
FIG. 2 is a perspective view of a washing machine of which a front surface is opened according to the present invention.

FIG. 2 is a perspective view of a washing machine of which a front surface is opened according to the present invention.

The washing machine according to one embodiment of the present invention comprises: a cabinet 10 for forming an appearance thereof; an outer tub 14 shock-absorbingly supported by a damper 12 at the cabinet 10 for storing washing water; an inner tub 16 rotatably arranged in the outer tub 14 for washing and dehydrating laundry; and a laundry heating unit arranged at an upper side of the cabinet 10 for spraying steam into laundry received into the inner tub 16.

A detergent box 20 connected to a water supply tube 18 is installed at an upper side of the outer tub 14 thus to supply detergent with washing water into the outer tub 14.

The heating unit is composed of a steam generator 24 arranged at an upper side of the cabinet 10 for generating steam, and a spray nozzle 26 for spraying steam generated from the steam generator 24 into the inner tub 16. Also, a circulation pump 28 for pumping water exhausted from the outer tub 14 and thereby re-supplying into the inner tub 16 through the spray nozzle 26 is installed at a lower side of the cabinet 10.

The spray nozzle 26 is provided with circulation water circulated by a pumping power of the circulation pump 28 and is provided with a diverge unit 30 for preventing steam generated from the steam generator 24 from flowing backwardly.

The circulation pump 28 is connected to an exhaustion pipe 36 for exhausting washing water stored in the outer tub 14 and is connected to the diverge unit 30 by a circulation tube 38.

The steam generator 24 is connected to a water supply tube 32 thus to receive water from outside, and is connected to the diverge unit 30 by a steam supply tube 34. Herein, at one side of the water supply tube 32, a water supply valve (not shown) for opening and closing the water supply tube 32 is mounted.

Figure 3:
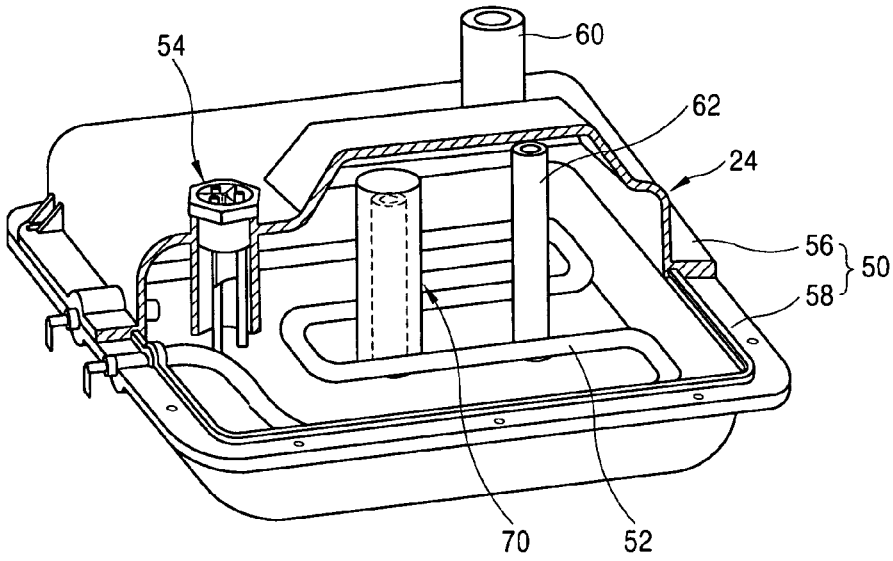
FIG. 3 is a perspective view showing a partially cut steam generator of the washing machine according to the present invention.

FIG. 3 is a perspective view showing a partially cut steam generator of the washing machine according to the present invention.

The steam generator 24 comprises: a hermetic container 50 to which the water supply tube 32 and the steam supply tube 34 are respectively connected; a heater 52 installed at a bottom of the hermetic container 50 for heating water supplied into the hermetic container 50; and a water level sensor 54 mounted in the hermetic container 50 for detecting a level of water supplied into the hermetic container 50.

An upper container 56 and a lower container 58 of the hermetic container 50 are hermetically mounted with a certain space therein. A water supply port 60 connected to the water supply port 32 is formed at one side of the upper container 56, and a steam exhaustion port 62 connected to the steam supply tube 34 for exhausting steam generated in the hermetic container 50 is formed at the lower container 58. Also, a drain unit 70 for draining water stored in the hermetic container 50 outwardly is installed at one side of the lower container 58.

The drain unit 70 is for maintaining inside of the hermetic container 50 with a clean state in order to protect the heater 52 inside of the hermetic container 50 by draining residual water outwardly. To the drain unit 70, a drain system for naturally draining without an additional open/close device such as the conventional solenoid valve and etc. is applied.

Figure 4:
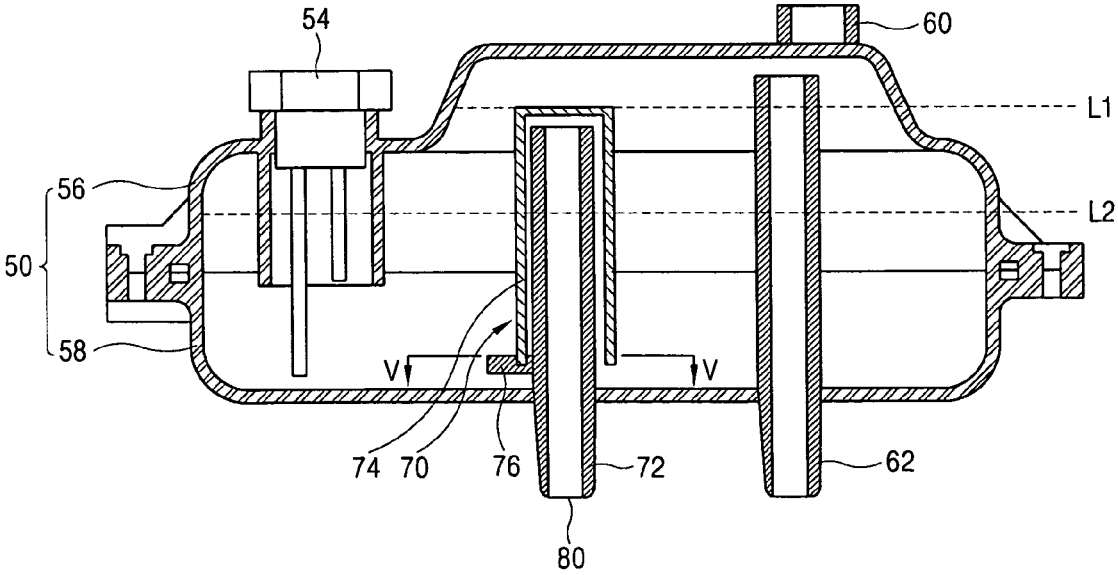
FIG. 4 is a sectional view of the steam generator of the washing machine according to the present invention.
Figure 5:
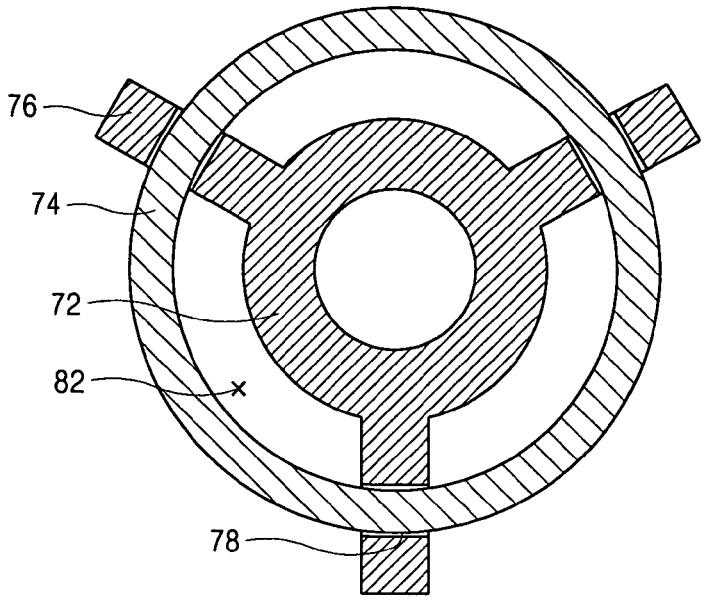
FIG. 5 is a sectional view taken along line V-V of FIG. 4.

That is, as shown in FIG. 4, the drain unit 70 is to drain residual water inside of the hermetic container 50 by a siphon operation.

The drain unit 70 comprises a siphon pipe 72 arranged to be penetrated at the lower container 58 with a vertical state, a siphon cap 74 arranged at an outer circumferential surface of the siphon pipe 72 with a certain interval for forming a channel along which water rises, and a supporting rib 76 for supporting the siphon cap 74 in order to maintain a certain interval between the siphon cap 74 and the siphon pipe 72.

An upper end of the siphon pipe 72 of a cylindrical pipe is positioned inside the hermetic container 50 and a lower end thereof is positioned outside the hermetic container 50, thereby forming a drain port 80. Herein, a height of the siphon pipe 72 vertically arranged in the hermetic container 50 is higher than a water supply level (L2). That is, at the time of steam generation from the steam generator 24, water is supplied only up to the water supply level (L2) thus not to generate a siphon operation in the siphon pipe 72. Also, at the time of draining, when water is further supplied than the water supply level (L2) thus to reach a water drain level (L1), the siphon operation is generated thus to naturally perform a drain operation.

The siphon cap 74 has a blocked upper side and covers the siphon pipe 72. Also, an opened lower end of the siphon cap maintains a certain interval with a bottom surface of the hermetic container 50 in order to introduce water.

Also, a plurality of supporting ribs 76 are radially formed at the outer circumferential surface of the siphon pipe 72 with a certain interval, and each supporting rib 76 is provided with a mounting groove 78 for mounting the lower end of the siphon cap 74. Accordingly, a certain channel 82 along which water rises is formed between the siphon pipe 72 and the siphon cap 74, and a certain interval is maintained between the supporting rib 76 and the bottom surface of the hermetic container 50 thus to introduce water.

The steam generator can be applied not only to the drum washing machine of the preferred embodiment but also to any washing machine.

Operation of the steam generator according to the present invention will be explained as follows.

Figure 6:
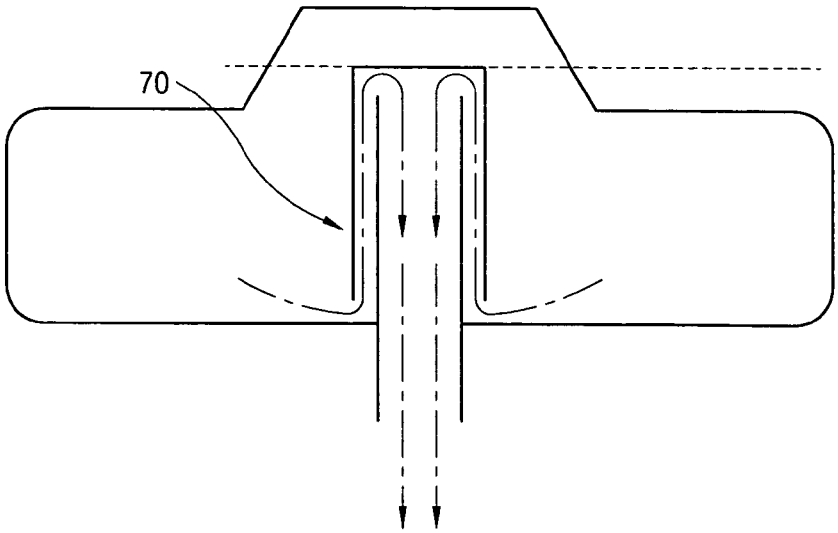
FIG. 6 is an operational state view of a drain unit of the steam generator of the washing machine according to the present invention.

FIG. 6 is an operational state view of the drain unit of the steam generator of the washing machine according to the present invention.

First, water is supplied into the hermetic container 50 through the water supply port 60 up to the water supply level (L2). Then, the heater 52 is operated thus to heat water stored in the hermetic container 50 and thereby to generate steam. At this time, the generated steam is exhausted through the steam exhaustion port 62 thus to be sprayed into the inner tub 16.

Herein, in order to protect the heater 52, water having a level enough to soak the heater 52 is stored in the hermetic container 50.

After the steam generation operation is completed, a drain operation for draining residual water inside of the hermetic container 50 outwardly is performed.

The drain operation will be explained in more detail.

First, water more than the water supply level (L2) is supplied into the hermetic container 50 thus to fill the hermetic container 50 up to the water drain level (L1). Then, by a siphon operation of the drain unit 70, water stored in the hermetic container 50 is naturally drained. That is, if water fills the hermetic container 50 up to the water drain level (L1), water inside of the hermetic container 50 fills the channel 82 between the siphon pipe 72 and the siphon cap 74 up to the same height. At this time, if water is drained through the upper end of the siphon pipe 72, water inside of the hermetic container 50 is all exhausted along the channel 82 through the siphon pipe 72.

In the steam generator of the washing machine according to the present invention, steam is sprayed into the inner tub thus to heat laundry, thereby reducing an entire size of the washing machine, reducing an amount of washing water, minimizing a consumption power, and reducing washing time.

Besides, residual water inside of the steam generator is exhausted outwardly by installing the drain unit in the steam generator, thereby maintaining cleanness of the steam generator.

Furthermore, residual water inside of the steam generator is naturally exhausted without an additional valve device by installing the drain unit using a siphon principle, thereby reducing a fabrication cost.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A drum laundry machine comprising:

a laundry tub;

a laundry drum located inside the laundry tub;

a water supply tube connected to a water supply valve;

a steam generator provided in the laundry machine, the steam generator including:

a container provided with a water supply port configured to be connected to the water supply tube of the laundry machine to receive water and a steam exhaustion port configured to be connected to a steam supply tube of the laundry machine to supply steam into the laundry tub of the laundry machine to perform a laundry course;

a heater to heat the water supplied into the container; and a drain unit having an inlet to drain water which remains inside the container, wherein the water supply valve supplies water to the steam generator through the water supply tube to operate the drain unit after supplying steam into laundry tub, thereby maintaining the cleanness of the steam generator.

2. The drum laundry machine of claim 1, wherein the drain unit includes a siphon structure.

3. The drum laundry machine of claim 1, wherein the drain unit comprises:

a siphon pipe arranged to penetrate a lower portion of the container, the siphon pipe including the inlet; and a siphon cap arranged at an outer circumferential surface of the siphon pipe with a certain interval for forming a channel along which water rises.

4. The drum laundry machine of claim 3, wherein the drain unit further comprises a supporting rib for supporting the siphon cap in order to maintain a certain interval between the siphon cap and the siphon pipe.

5. The drum laundry machine of claim 3, wherein the upper end of the siphon pipe is positioned inside the container, a lower end thereof is positioned outside the container, and a height of the siphon pipe positioned inside the container is higher than a water level which is predetermined as a limit level when supplying water into the container for generating steam.

6. The drum laundry machine of claim 3, wherein the siphon cap has a blocked upper side and covers the siphon pipe, and a lower end of the siphon cap is arranged to maintain a certain interval with a bottom surface of the container in order to introduce water.

7. The drum laundry machine of claim 4, wherein the supporting rib is radially formed at an outer circumferential surface of the siphon pipe with a certain interval, and is provided with a mounting groove for mounting a lower end of the siphon cap.

8. The drum laundry machine of claim 1, wherein the water is drained through a bottom of the container.

9. The drum laundry machine of claim 1, wherein the drain unit operates when the water inside the container reaches a predetermined level.

10. The drum laundry machine of claim 1, wherein the drain unit is configured to drain almost all the water in the container.

11. A drum laundry machine comprising:

a laundry tub;

a laundry drum located inside the laundry tub;

a water supply tube connected to a water supply valve;

a steam generator including:

a container provided with a water supply port connected to the water supply tube to receive water and a steam exhaustion port to exhaust steam;

a heater to heat the water supplied into the container; and a drain unit to drain water which remains inside the container;

means for spraying the exhausted steam directly into the laundry drum to perform a laundry course, the means being connected to the steam exhaustion port of the steam generator, wherein the heater heats water in the container when the supply valve supplies water to the container up to a predetermined water level and the supply valve supplies water to the container up to a second water level to operate drain unit after supplying the steam into the laundry drum to maintain cleanness of the steam generator.

12. The drum laundry machine of claim 11, further comprising means for spraying exhausted water from the laundry tub directly into the laundry drum.

13. The drum laundry machine of claim 12, wherein the drain unit is configured to drain almost all the water in the container.

14. The drum laundry machine of claim 11, wherein the second water level is higher than the predetermined water level.

15. The drum laundry machine of claim 9, wherein the water supply tube is connected to a water supply valve of the drum laundry machine.

16. A drum laundry machine comprising:

a laundry tub;

a laundry drum located inside the laundry tub;

a water supply tube connected to a water supply valve;

a steam generator provided in the laundry machine, the steam generator including:

a container provided with a water supply port connected to the water supply tube to receive water, and a steam exhaustion port to exhaust steam;

a heater to heat the water supplied into the container; and a drain unit to drain water which remains inside the container;

means for spraying the exhausted steam to the laundry drum, the means connected to the steam exhaustion port of the steam generator, wherein the water supply valve is configured to supply water into the container until a water level of the container reaches a predetermined water level and then is configured to supply water into the container until the water level reaches a second water level to operate the drain unit to drain almost all the water in the container, thereby maintaining cleanness of the steam generator.

* * * * *